United States Patent [19]

Bunyan

[11] 4,345,699

[45] Aug. 24, 1982

[54] LUBRICANT TANK

[75] Inventor: Clive N. Bunyan, Harrow, England

[73] Assignee: Rolls-Royce Limited, London, England

[21] Appl. No.: 204,700

[22] Filed: Nov. 6, 1980

[30] Foreign Application Priority Data

Dec. 7, 1979 [GB] United Kingdom ..... 7942305

[51] Int. Cl.[3] ..... B67D 5/32

[52] U.S. Cl. ..... 222/40; 222/382; 184/1 C; 184/6.4

[58] Field of Search ..... 222/23, 40, 24, 464, 222/382; 184/1 C, 6.4, 6.28; 116/70

[56] References Cited

U.S. PATENT DOCUMENTS 2,910,940 11/1959 Colman et al. ..... 222/23 X 3,200,389 8/1965 Damico et al. ..... 222/23

3,618,709 11/1971 Boelkins ..... 184/6.4

4,105,092 8/1978 Zeidler et al. ..... 184/1 C X 4,299,307 11/1981 Scott ..... 184/6.4 X

*Primary Examiner*—Allen N. Knowles

*Attorney, Agent, or Firm*—Cushman, Darby & Cushman

[57] ABSTRACT

A tank suitable for holding a lubricant is provided with a dipstick. A sleeve which is mounted on the tank and adapted to support the dipstick is interconnected with the output duct of the tank by means of a further duct. The arrangement is such that if the dipstick is incorrectly located in the sleeve, air is permitted to flow through the further duct into the output duct so that the pressure of the lubricant in the output duct is reduced. This pressure reduction consequently provides an indication of incorrect dipstick location.

6 Claims, 2 Drawing Figures

LUBRICANT TANK

This invention relates to tanks suitable for holding a lubricant and in particular tanks which are provided with a dipstick adapted to indicate the level of lubricant within the tank.

Tanks suitable for holding a lubricant are frequently provided with a dipstick in order that the level of the lubricant within the tank may be checked. If the tank in question is liable in use to alterations in its attitude, it is necessary to ensure that a seal is provided between the dipstick and the tank in order that lubricant is not lost. However, after the lubricant level has been checked using the dipstick, it sometimes happens that the dipstick is not correctly re-positioned in the tank. If such incorrect positioning is not noticed, lubricant leakage can occur.

An additional problem exists with lubricant tanks adapted for use with aircraft engines. Thus since aircraft are sometimes required to undergo quite violent and extreme changes in attitude, it is usually necessary to provide their engine lubricant tanks with dipsticks which lock in position. If such dipsticks are incorrectly positioned, their locking mechanisms may be rendered inoperative so that in flight, lubricant leakage can occur and indeed the dipstick itself may be lost. Loss of the dipstick is extremely serious since it could result in a very rapid loss of all of the lubricant contained within the tank.

It is an object of the present invention to provide a lubricant tank having a dipstick and which is provided with means adapted to indicate if the dipstick is incorrectly positioned.

According to the present invention, a tank suitable for holding a lubricant is provided with a removable dipstick, means adapted to receive and support said dipstick, first duct means adapted for the withdrawal of lubricant from said tank, second duct means interconnecting said first duct means with said dipstick support means, and pump means associated with said first duct means, said pump means being adapted to pump lubricant from said tank through said first duct means, said dipstick and dipstick support means being adapted and arranged such that said second duct means is obturated only when said dipstick is correctly positioned in said dipstick support means, said second duct means being so adapted and arranged that when not so obturated by said dipstick, air is drawn therefrom into said first duct means by the action of said pump means to reduce the pressure of said lubricant within said first duct means, means being provided to detect and indicate said pressure reduction.

Said dipstick support means is preferably provided with an orifice which is interconnected in flow series with said duct means and so positioned as to be obturated by said dipstick only when said dipstick is correctly positioned in said dipstick support means.

Said orifice is preferably of such a size that when it is not so obturated by said dipstick, it permits an air flow through said second duct means into said first duct means which is of such a magnitude that a detectable pressure drop of the lubricant contained within said first duct means occurs without the de-priming of said pump means.

Said dipstick is preferably provided with two spaced apart sealing means, each adapted to provide a seal between said dipstick and said dipstick support means, said two sealing means being so arranged that when said dipstick is correctly positioned in said dipstick support means, said orifice in said dipstick support means is positioned intermediate said two sealing means so as to be obturated thereby.

Said dipstick and said dipstick support means may be adapted to lock together when said dipstick is correctly located in said dipstick support means.

Said second duct means is preferably interconnected with said first duct means at a position intermediate said pump means and that portion of said first duct means terminating within lubricant contained in operation within said tank.

The invention will now be described with reference to the accompanying drawings in which.

Figure 1:
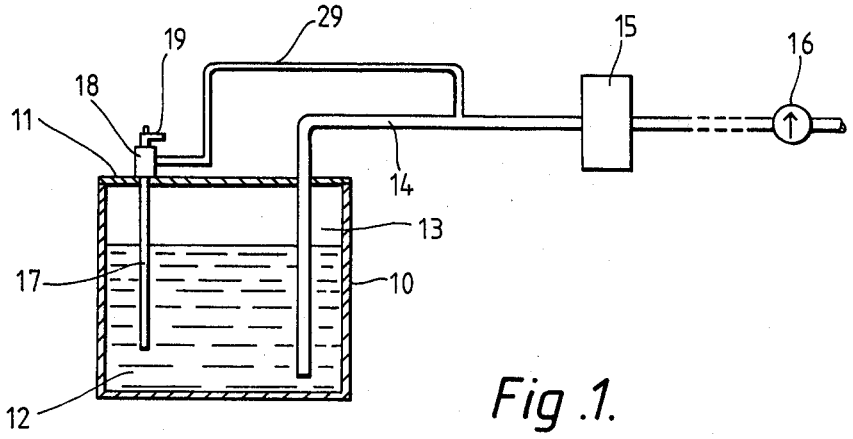
FIG. 1 is a partially sectioned side view of a lubricant tank in accordance with the present invention.

With reference to FIG. 1, a lubricant tank 10 suitable for an aircraft engine is provided with a lid 11 and contains a lubricant 12. An air space 13 exists above the lubricant 12 and a vent (not shown) ensures that the air contained within the air space 13 remains at ambient pressure. A first duct 14 extends through the tank lid 11 and terminates below the level of the lubricant 12. The duct 14 is intended for the withdrawal of lubricant 12 from the tank 10 and to achieve this end, a pump 15 is positioned in flow series with the duct 14. A pressure gauge 16 downstream of the pump 15 monitors the pressure of lubricant 12 contained within the duct 14 downstream of the pump 15. The pressure gauge 16 is conveniently located in the cockpit of the aircraft provided with the tank 10.

In order that the level of the lubricant 12 contained within the tank 10 may be checked, a dipstick 17 is provided. The dipstick 17 is supported by a sleeve 18 which is mounted on the tank lid 11. The manner of construction of the dipstick 17 and sleeve 18 can be seen more clearly in FIG. 2.

Figure 2:
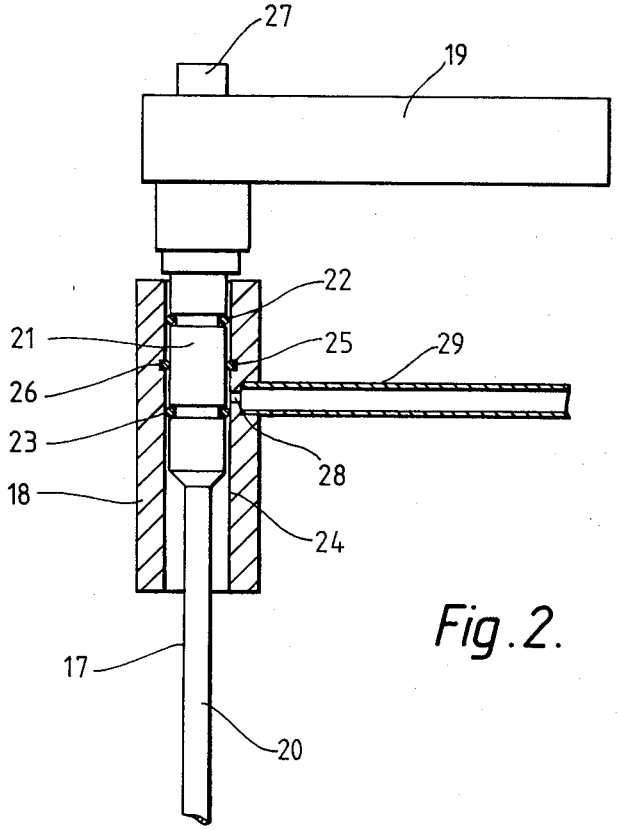
FIG. 2 is an enlarged partially sectioned side view of a portion of the lubricant tank shown in FIG. 1.

With reference to FIG. 2, the dipstick 17 is provided with a handle 19 to facilitate its removal from the tank 10. The remainder of the dipstick 17 is constituted by the blade portion 20 which extends into the lubricant 12 and a cylindrical portion 21 which locates in the sleeve 18. The cylindrical dipstick portion 21 is provided with two spaced apart O ring seals 22 and 23 which engage the radially inner wall 24 of the sleeve 18 so as to provide a seal which prevents the loss of lubricant 12 in the event of changes in altitude of the tank 10.

The cylindrical dipstick portion 21 is further provided with a pair of radially projecting location members 25 which are adapted to seat in an annular groove 26 provided in the inner sleeve wall 24. The location members 25 thus lock the dipstick 17 in position in the sleeve 18. If it is desired to remove the dipstick 17 in order for instance to check the level of the lubricant 12, the location members 25 are withdrawn into the dipstick 17 by means of a suitable mechanism contained within the cylindrical dipstick portion 21 and which is actuated by means of a push button 27 provided on the dipstick handle 19.

The sleeve 18 is provided with an orifice 28 which serves to provide communication between the interior of the sleeve 18 and a second duct 29. The second duct 29 extends between the orifice 29 and the first duct 14 as can be seen more clearly in FIG. 1.

The orifice 28 is so positioned in the sleeve 18 that when the dipstick 17 is correctly positioned as shown in FIG. 2, the orifice is positioned intermediate the seals 22 and 23 and adjacent the lower seal 23. Consequently the seals 22 and 23 effectively obturate the orifice 28 and thus the second duct 29. If, however, the dipstick 17 is not correctly positioned in the sleeve 18, the seals 22 and 23 no longer obturate the orifice 28 so that the orifice 28 and second duct 29 are in flow communication with the air space 13 within the tank. Since, as previously stated, the tank 10 is vented to atmosphere, this means that the flow of lubricant through the first duct 14 results in air being drawn from the air space 13, through the second duct 29 and into the first duct 14. The introduction of air into the lubricant flowing through the first duct 14 results in a reduction in lubricant pressure which is in turn detected and indicated by the pressure gauge 16.

The dimensions of the orifice are chosen such that in the event of incorrect positioning of the dipstick 17, the magnitude of the airflow through the second duct is sufficiently high to ensure a noticeable reduction in lubricant pressure without resulting in the de-priming of the oil pump 16.

It will be seen therefore that if the dipstick 17 is not correctly positioned in the sleeve 18 or is even missing, there will be a resultant reduction in the pressure indicated by the pressure gauge 16. Thus in the case of an aircraft mounted lubricant tank, if after starting the aircraft's engines, the pilot is given an indication of low lubricant pressure, one of his actions would be to check whether the lubricant tank dipstick was correctly positioned. The present invention therefore provides a simple means for the indication of incorrect dipstick positioning which is not dependent upon vulnerable electrical devices.

I claim:

1. A tank suitable for holding a lubricant and comprising a removable dipstick, means for the reception and support of said dipstick, first duct means for the withdrawal of lubricant from said tank, second duct means interconnecting said first duct means with said dipstick support means, and pump means associated with said first duct means, said pump means being adapted to pump lubricant from said tank through said first duct means, said dipstick and dipstick support means being adapted and arranged such that said second duct means is obturated only when said dipstick is correctly positioned in said dipstick support means, said second duct means being so adapted and arranged that when not so obturated by said dipstick, air is drawn therefrom into said first duct means by the action of said pump means to reduct the pressure of said lubricant within said first duct means, means being provided to detect and indicate said pressure reduction.

2. A tank suitable for holding a lubricant as claimed in claim 1 wherein said dipstick support means is provided with an orifice which is interconnected in flow series with said duct means and so positioned as to be obturated by said dipstick only when said dipstick is correctly positioned in said dipstick support means.

3. A tank suitable for holding a lubricant as claimed in claim 2 wherein said orifice is of such a size that when it is not obturated by said dipstick, it permits an air flow through said second duct means into said first duct means which is of such a magnitude that a detectable pressure drop of the lubricant contained within said first duct means occurs without the de-priming of said pump means.

4. A tank suitable for holding a lubricant as claimed in claim 2 wherein said dipstick is provided with two spaced apart sealing means, each adapted to provide a seal between said dipstick and said dipstick support means, said two sealing means being so arranged that when said dipstick is correctly positioned in said dipstick support means, said orifice in said dipstick support means is positioned intermediate said two sealing means so as to be obturated thereby.

5. A tank suitable for holding a lubricant as claimed in claim 1 wherein locking means are provided to lock together said dipstick and said dipstick support means when said dipstick is correctly located in said dipstick support means.

6. A tank suitable for holding a lubricant as claimed in claim 1 wherein said second duct means is interconnected with said first duct means at a position intermediate said pump means and that portion of said duct means terminating within lubricant contained in operation within said tank.

* * * * *